United States Patent [19]

Davies

[11] 4,216,898

[45] Aug. 12, 1980

[54] CIGARETTE PACKETS

[75] Inventor: Robert W. Davies, London, England

[73] Assignee: Molins Limited, London, England

[21] Appl. No.: 870,170

[22] Filed: Jan. 17, 1978

Related U.S. Application Data

[63] Continuation of Ser. No. 712,299, Aug. 6, 1976, abandoned, which is a continuation-in-part of Ser. No. 584,072, Jun. 5, 1975, abandoned.

[51] Int. Cl.[2] ..... B65D 5/34

[52] U.S. Cl. ..... 229/44 CB; 229/23 BT; 206/259; 206/273; 220/408

[58] Field of Search ..... 229/44 CB, 51 C, 23 R, 229/23 BT, 14 BA, 14 BE, 14 BW, 14 R; 206/259, 248, 242, 271, 273, 275; 220/93, 408, 410

[56] References Cited

U.S. PATENT DOCUMENTS

| | | | |
|---|---|---|---|
| 2,247,870 | 7/1941 | Chalmers | 229/44 CB |
| 2,958,417 | 11/1960 | Adams | 229/44 CB |
| 3,395,787 | 8/1968 | Plaskan | 206/259 |
| 3,570,703 | 3/1971 | MacRae | 220/42 A |
| 3,979,047 | 3/1976 | Focke et al. | 229/44 CB |

FOREIGN PATENT DOCUMENTS

| | | | |
|---|---|---|---|
| 654558 | 12/1962 | Canada | 229/44 CB |
| 72047 | 11/1944 | Norway | 229/93 |

*Primary Examiner*—Joseph Man-Fu Moy
*Attorney, Agent, or Firm*—John C. Smith, Jr.

[57] ABSTRACT

A hinged lid packet has an inner frame provided at each side with a downwardly facing edge, which engages with a upwardly facing edge in the side wall of the packet to limit downward movement of the inner frame. The edge in the inner frame may be formed by an outwardly bent corner; and the corresponding edge in the side wall may be formed by a rectangular cut-out, such as a slot.

17 Claims, 8 Drawing Figures

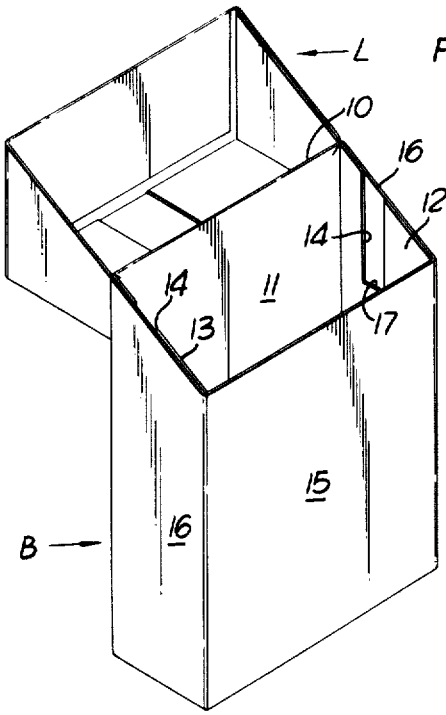
Fig. 1.
Fig. 3.
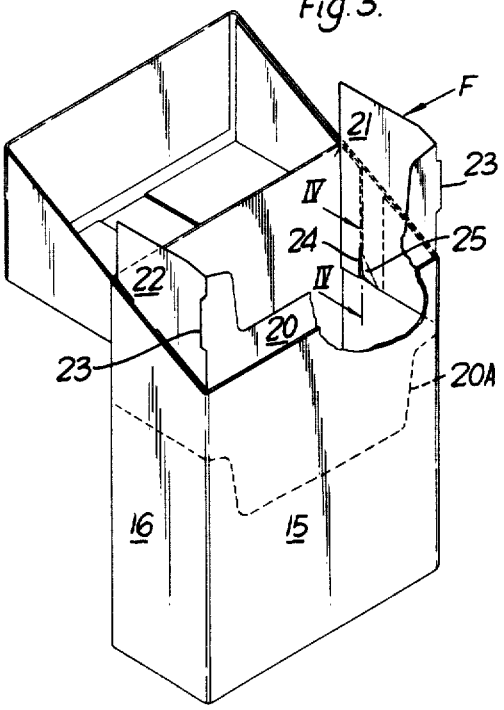
Fig. 4.
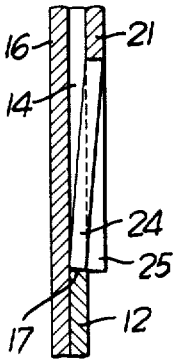

CIGARETTE PACKETS

This is a continuation of application Ser. No. 712,299 filed Aug. 6, 1976 (now abandoned) which is a continuation-in-part of application Ser. No. 584,072 filed June 5, 1975 (now abandoned).

This invention relates to packets for cigarettes or similar rod-like articles and in particular to hinged lid packets.

Hinged lid packets are commonly made from two blanks, one blank forms the lid and body of the packet, and the other blank, herein referred to as the inner frame, is mounted inside the body and forms an extension of the top of the body against which the inside of the lid bears frictionally when closed. Since the inner frame provides the locking action for the lid, it requires to be accurately positioned relative to the body and hence to the lid. But in the production of hinged lid packets difficulties have sometimes been experienced in meeting this requirement.

According to the present invention there is provided a hinged lid packet comprising; a body having a back wall, a front wall, a pair of side walls, and a base, a lid having front and side portions, and a rear portion hinged to said back wall; and an inner frame having a pair of side panels and a front panel which are mounted respectively against the inside of said side and front walls and which project upwardly beyond the level of said rear wall so as to bear frictionally against the inside of the lid when closed; at least one panel of the inner frame and an adjacent wall of the body having abutting edges which face downwardly and upwardly respectively, to limit movement of the inner frame towards the base; one of said abutting edges being provided by a projection which protrudes from the plane of the panel or wall into the plane of the adjacent wall or panel.

Preferably said projection is provided at each side panel of the inner frame, and each side wall of the body consists of inner and outer layers of material, for example card, the upwardly facing abutting edge of each side wall being formed by a substantially rectangular cut-out towards the top of each inner layer.

The projection may be provided by an ear formed as an extension of the front panel of the inner frame at each corner of the inner frame, and the cut-out may be formed at the top front edge of the inner layer of each side wall, the cut-out being defined by a long vertical edge and a relatively short horizontal edge.

The projection may alternatively be provided on the upwardly facing abutting edge of each side wall. However, in some circumstances such a packet when being formed about an article to be packed may suffer from the disadvantage that said projection could engage against the bottom edge of the article, or the internal wrapper of the article, before abutment with the downwardly facing edge of the inner frame. As a result damage may be caused to the wrapped article or to the projection from the side wall of the packet, or to both.

Two embodiments of hinged lid packets according to the invention will now be described, by way of example, with reference to the accompanying drawings in which:

FIG. 1 is a perspective view of a lid and body of one embodiment of a packet without its inner frame;

FIG. 3 is a perspective view of the packet including the inner frame, with some parts cut away for clarity;

FIG. 4 is an enlarged sectional view of a side of the packet taken on the line IV—IV of FIG. 3;

Figure 2:
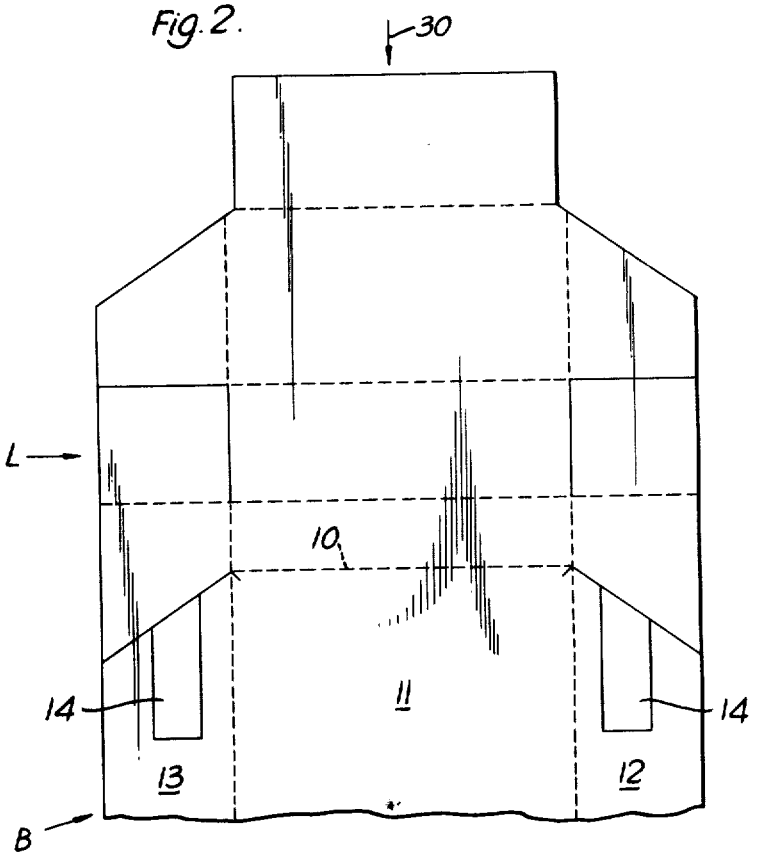
FIG. 2 is a view of part of a blank from which the packet of FIG. 1 is made.

Referring first to FIGS. 1 and 2, the lid L of the hinged lid packet is formed from the panels of the blank above the hinge line 10. The blank is made of a card material. FIG. 2 shows only a part of the panels which form a back wall 11 and inner side walls 12 and 13 of the body B of the packet. For a more complete understanding of the construction of a typical hinged lid packet and of the blank from which it is made, reference may be made for example, to British Pat. No. 652,177.

A substantially rectangular slot 14 is cut in each of the inner side wall 12 and 13. Each side edge of the slot is vertical and, as can be seen from FIG. 1 the bottom upwardly facing edge 17 of the slot 14 extends below the level of the front wall 15 of the body. The outer side walls 16 of the body enclose the slot so that it is hidden from view from the outside when the packet is closed.

Figure 6:
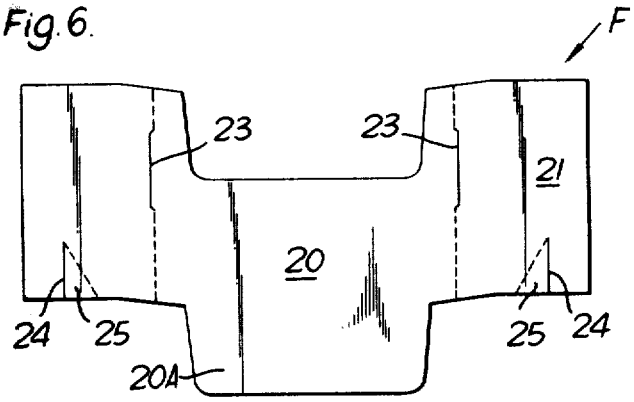
FIG. 6 is a view of the blank of the inner frame.

FIG. 3 shows an inner frame F mounted in the body of the packet. The inner frame is made from the blank shown in FIG. 6, and consists of a conventional front wall or panel 20 which has a cut-out shape to allow access to the cigarettes (not shown) in the packet, and of side walls or panels 21 and 22 bent back to extend normally from the front panel. Ears 23 project outwardly from the corners between the side panels and the front panel 20, again as conventional.

The blank for the inner frame F (see FIG. 6) is made from a continuous strip of card material; and in order to make the blank economically without wasting material, it is desirable to make the top and bottom profiles of the blank of the same shape, so that one blank will nest into another. For this reason the front panel 20 has a downwardly dependent tab 20A (also as coventional) which corresponds with the shape of the cut-out above it.

A vertical cut 24 is made at the lower edge of each side panel of the inner frame F. (Since the side panel 21 is similar to the other side panel 22, only the former panel will be described). The cut 24 coincides with the rear vertical edge of the slot 14 in the inner side wall 12.

As can be seen from the enlarged sectional view of FIG. 4, the corner 25 formed by the cut 24 is bent outwards and acts as a detent to engage the bottom edge 17 of the slot 14. It will thus be apparent that, provided the height of the side panel 21 and 22 of the inner frame F, and the depth of the slot 14 are accurately made to predetermined dimensions, the position of the top of the inner frame relative to the body will also be accurate, thereby providing a precise locking action for the lid.

The method by which the corners 25 of the inner frame F are positioned against the slots 14 will now be briefly described in relation to a conventional hinged lid packing machine. In such a machine, when used for forming a conventional hinged lid packet the conventional inner frame is positioned fairly accurately over a cigarette bundle before the bundle and inner frame are fed in a direction, as shown by arrow 30 in FIG. 2, on to the back wall of a conventional blank. A locating device on the machine subsequently repositions the inner frame before the front wall is folded over on to the inner frame and glued to it.

However, in the case of the present packet, as the inner frame F on the bundle of cigarettes is being fed on to the blank in the direction of arrow 30, the corners 25 enter the slots 14 in the at least partly upturned side walls 12 and 13 and so locate the inner frame accurately relative to the packet blank. There is no need for a locating device before the inner frame is glued to the front wall—in fact such gluing may not even be necessary. Furthermore, in contrast to the forming of a conventional packet, the initial positioning of the inner frame F on the bundle need not be so accurate, provided the inner frame is slightly ahead of the bundle as considered in the direction of arrow 30 (i.e. below the bundle relative to its final position) so that the bundle is slid into position on the back wall 11 of the blank under the already located inner frame F.

Figure 5:
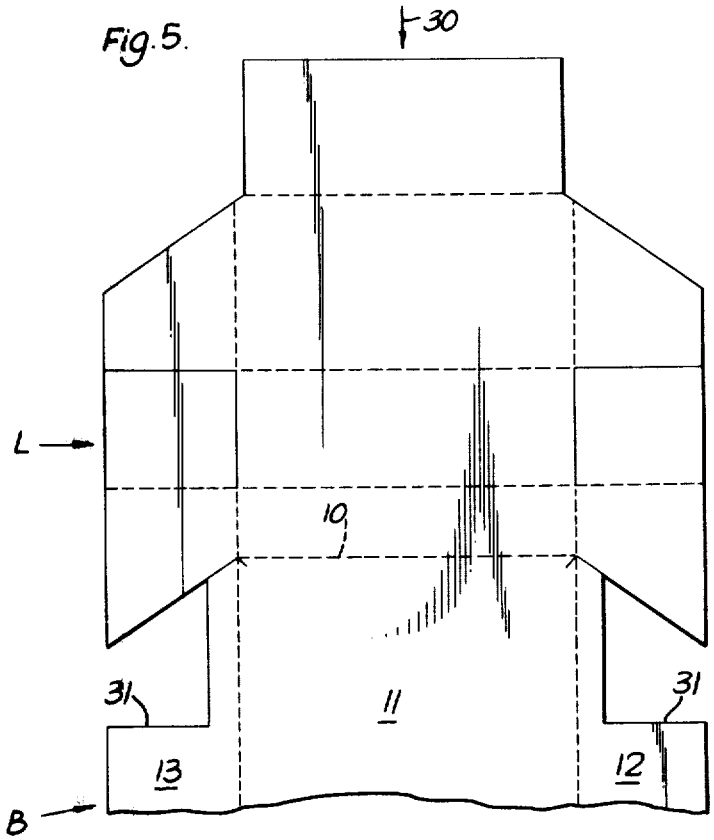
FIG. 5 is a view of a modification of a part of the blank of FIG. 2.

In the modification of the blank shown in FIG. 5, the slot 14 is replaced by a larger cut-out 31. The depth of this cut-out is the same as that of the slot 14, and the blank is in other respects the same as that of FIG. 2.

Figure 7:
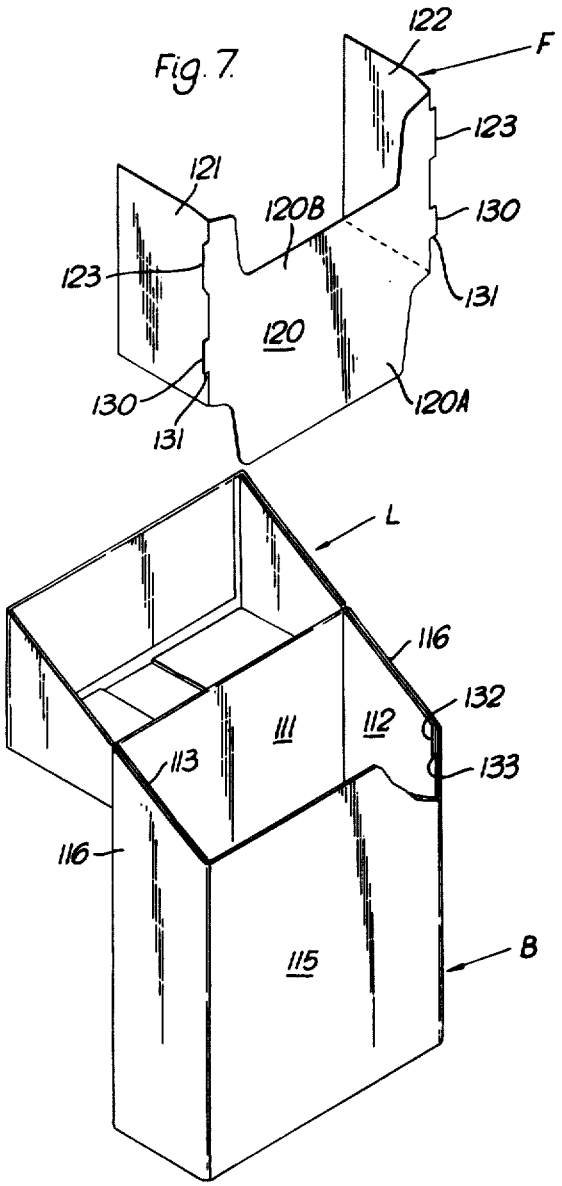
FIG. 7 is an exploded perspective view of a second embodiment of a packet.

A packet according to a second embodiment of the invention is shown in FIG. 7. The packet is similar to that shown in FIG. 3 in that it consists essentially of a body B to which a conventional lid L is hinged, and a separate inner frame F, shown vertically removed from the body.

The body B includes a back wall 111 a front wall 115, inner side walls 112 and 113, and outer side walls 116 which overlap the inner side walls.

The inner frame F has a front wall or panel 120 with a conventional cut-out 120B corresponding to the shape of a downwardly dependent tab 120A, and a pair of side walls or panels 121 and 122. At the corners between the side and front panels are outwardly projecting upper ears 123 which, again as conventional, are adapted to bear frictionally against the inside of the lid when closed.

Spaced beneath each upper ear 123 is a lower ear 130, which is somewhat shorter than the ear 123, and which has a substantially horizontal downwardly facing edge 131. Each ear 130 is adapted to enter into a rectangular cut-out at the top front corner of the respective inner side wall 112 and 113 of the body.

The upper and lower ears 123, 130 are formed as extensions of the front panel 120, by making substantially rectangular U-shaped cuts based on the lines of junction between said front panel and the side panels 121, 122 prior to folding the side panels into their positions at right-angles to the front panel.

As can be seen behind the broken away portion at the right of the front wall 112, the cut-out in the side wall 115 (the obscured cut-out in the side wall 113 being similar) is defined by a long vertical edge 132 and a relatively short horizontal edge 133. On being entered into the cut-outs, the downwardly facing edges 131 of the lower ears 130 abut the short edges 133 of the respective cut-outs, thus serving to limit downward movement of the inner frame as in the packet of first embodiment described above.

It will be apparent that the ears 130 could be formed lower down the corners of the inner frame, or even at the bottom of the corners so that the downwardly facing edges 131 are in line with the lower edges of the respective side panels 121 and 122. The cut-outs in the side walls 112 and 113 would then need to be formed correspondingly deeper than shown in FIG. 7, i.e. the horizontal edges 133 being lower and the vertical edges 132 longer.

Figure 8:
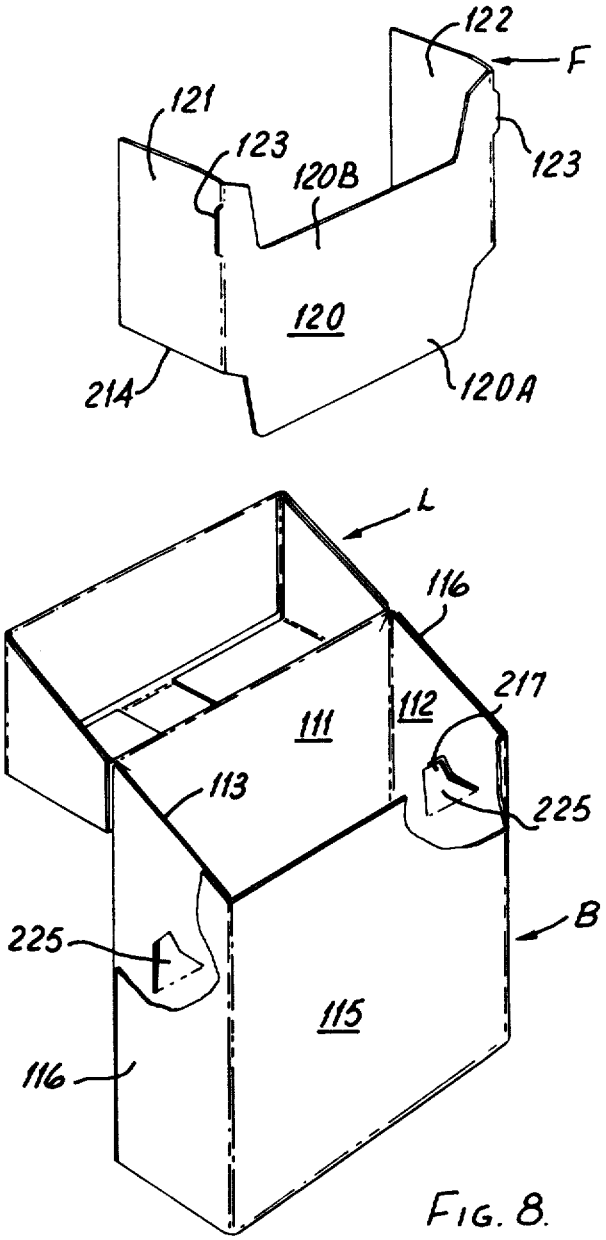
FIG. 8 is an exploded perspective view of a third embodiment of a packet.

As an alternative to the above two embodiments, a similar locating effect to that described could be achieved in a packet as shown in FIG. 8 wherein those parts substantially the same as shown in FIG. 7 are identified by the same numeral. A projection 225 from each inner side wall 112 of the body is formed at an appropriate level to abut the lower edge 214 of the respective side wall or panel 121 or 122 of a conventional inner frame. The projection could be formed by an L-shaped cut 224 which is inwardly bent and which faces upwards and preferably towards the back wall 111 of the body respectively. At each corner between the L-shaped cut there could be an upwardly extending lip 217 adapted to hook securely behind the lower edge 214 of the inner frame.

I claim:

1. A hinged lid packet comprising a body having a back wall, a front wall, a pair of side walls and a base; a lid having front and side portions, and a rear portion hinged to said back wall; and an inner frame having a pair of side walls and a front wall which are mounted respectively against the inside of said side and front walls of said body, providing pairs of adjacent front and side walls, and which project upwardly beyond the upper level of said back wall so as to bear frictionally against the inside of said side and front portions of the lid when closed and extend downwardly interiorally of said body to a position intermediate said base and said upper level of said back wall, the wall of said body of at least one of said pairs of adjacent walls comprising inner and outer layers of material; at least one pair of abutting edges located at said at least one of said pairs of adjacent walls, one of said abutting edges of each pair being located at the wall of said inner frame and the other of said abutting edges being located at the inner layer of the adjacent wall of said body, the abutting edges of each pair facing upwardly and downwardly respectively to limit movement of said inner frame towards said base, one of said abutting edges being formed by a projection which protrudes from the plane of the wall of said inner frame into the plane of the inner layer of the adjacent wall of said body and faces downwardly and the other of said abutting edges being formed by a cut-out in said inner layer of said adjacent wall of said body and facing upwardly, said outer layer of said adjacent wall of said body being imperforate and being disposed in a plane contiguous to said inner layer.

2. A hinged lid packet as claimed in claim 1 wherein said pairs of abutting edges are located at both side walls of said body and inner frame respectively.

3. A hinged lid packet as claimed in claim 1 wherein the inner layer of the wall of said body of at least one of said adjacent pairs of walls includes a cut-out extending from the top edge of said inner layer and forming one of said abutting edges, said projection protruding from the adjacent wall of said inner frame with the other of said abutting edges thereon being in abutting relationship with said one abutting edge of said inner layer of said wall of said body.

4. A hinged lid packet as claimed in claim 1 wherein each of said side walls is joined to said front wall of said inner frame along a fold line and said projection protrudes from a wall of said inner frame at said fold line and said cut-out in said inner layer of said adjacent wall of said body is contiguous to the respective intersection between said side and front walls of said body.

5. A hinged lid packet comprising:

a body having a back wall, a front wall, a pair of side walls, and a base, each side wall comprising inner and outer layers of material; a lid having front and side portions, and a rear portion hinged to said back wall; and an inner frame having a pair of side panels and a front panel which are mounted respectively against the inside of said side and front walls and which project upwardly beyond the upper level of said back wall so as to bear frictionally against the inside of said side and front portions of the lid when closed and extend downwardly interiorally of said body to a position between said base and said upper level of said back wall; the side panel of the inner frame and the adjacent side wall of the body at each side of the packet having abutting edges which face downwardly and upwardly respectively to limit movement of the inner frame towards the base; the upwardly facing abutting edge of each side wall being formed by a cut-out in each inner layer of each side wall, and the downwardly facing abutting edge of each side panel being formed by a projection which protrudes from the plane of the panel into the plane of the inner layer of the adjacent wall, and said outer layer of each side wall being imperforate and being disposed in a plane contiguous to said inner layer.

6. A hinged lid packet comprising:

(a) a body comprising a back wall, a front wall spaced from said back wall, a pair of spaced side walls extending between said back and front walls and a base extending between said back, front and side walls;

(b) a lid comprising a top, a front portion extending from said lid, a pair of side portions extending from said top and front portions and a hinge joining said lid and back wall; and (c) an inner frame comprising a front wall and a pair of side walls extending from opposite sides of said front wall, respectively, said front and side walls of said inner frame being mounted respectively against the interior of said front and side walls respectively of said body and arranged to project upwardly beyond the upper level of said front and side walls of said body so as to bear frictionally against the interior of said front and side portions of said lid when closed and to extend downwardly interiorally of said body to a position between said base and said upper level of said front and side walls;

(d) at least one of said side walls of said inner frame and said body at each side of said packet including at least one projection having an abutting edge and protruding from the plane of said side wall into the plane of the adjacent other side wall, said projection being formed by an outwardly bent corner at the lower edge of each of said side walls of said inner frame, said corner being defined by a substantially vertical cut in said lower edge, and said adjacent other side wall including at least one recess having a further abutting edge in the interior of said other side wall, said abutting edges of said side walls of said inner frame and of said body confrontingly facing downwardly and upwardly, respectively, to prevent movement of said inner frame toward said base beyond a predetermined point.

7. A hinged lid packet as claimed in claim 6 in which said recess is in the interior of said side wall of said body said recess being defined in part by a rear substantially vertical edge and by said upwardly facing abutting edge, said substantially vertical cut in each of said side walls of said inner frame corresponding with said rear substantially vertical edge of said recess in said side wall of said body.

8. A hinged lid packet as claimed in claim 7 wherein said recess in the interior of each of said side walls is of substantially rectangular configuration extending downwardly from the top of each of said side walls to said upwardly facing abutting edge.

9. A hinged lid packet comprising a body having a back wall, a front wall, a pair of side walls, each having inner and outer layers of material, and a base; a lid having front and side portions, and a rear portion hinged to said back wall; and an inner frame having a pair of side panels and a front panel which are mounted respectively against the inside of said side and front walls and which project upwardly beyond the upper level of said back wall so as to bear frictionally against the inside of said side and front portions of the lid when closed and extend downwardly interiorally of said body to a position between said base and said upper level of said back wall; at least one of said panels of the inner frame having at least one first abutting edge and a wall of the body adjacent said first abutting edge having a further abutting edge engaging said first abutting edge, said abutting edges facing downwardly and upwardly respectively to limit movement of the inner frame towards the base; each side of said inner frame being provided with a projection having said downwardly facing abutting edge, said projection protruding into the plane of the inner layer of said respective side wall, and each inner layer of said side walls being provided with a substantially rectangular cut-out towards the top thereof forming said upwardly facing abutting edge, and each outer layer of said side walls being imperforate and being disposed in a plane contiguous to said inner layer.

10. A hinged lid packet as claimed in claim 9 in which said projection is provided by an ear formed as an extension of the front panel of the inner frame at each corner between the front and side panels of the inner frame, and in which said cut-out is formed at the top front edge of the inner layer of each side wall, said cut-out being defined by a long vertical edge and a relatively short horizontal edge.

11. A hinged lid packet comprising:

a body having a back wall, a front wall, a pair of side walls, and a base, each side wall comprising inner and outer layers of material; a lid having front and side portions, and a rear portion hinged to said back wall; and an inner frame having a pair of side panels and a front panel which are mounted respectively against the inside of said side and front walls and which project upwardly beyond the upper level of said back wall so as to bear frictionally against the inside of said side and front portions of the lid when closed and extend downwardly interiorally of said body to a position between said base and said upper level of said back wall; the side panel of the inner frame and the adjacent side wall of the body at each side of the packet having abutting edges which face downwardly and upwardly respectively to limit movement of the inner frame towards the base; the upwardly facing abutting edge of each side wall being formed by a cut-out in each inner layer of each side wall and the downwardly facing abutting edge of each side panel being formed by a projection which protrudes from the plane of the panel into the plane of the adjacent wall, said projection being formed by an outwardly bent corner at the lower edge of each side panel, said corner being defined by a vertical cut in said lower edge.

12. A hinged lid packet as claimed in claim 11 in which said cut-out in the inner layer of each side wall is in the shape of a slot defined by front and rear vertical edges and by said upwardly facing abutting edge, said vertical cut in each side panel of the inner frame corresponding with the rear vertical edge of the slot in the adjacent side wall.

13. A hinged lid packet comprising:

a body having a back wall, a front wall, a pair of side walls, and a base, each side wall comprising inner and outer layers of material; a lid having front and side portions, and a rear portion hinged to said back wall; and an inner frame having a pair of side panels and a front panel which are mounted respectively against the inside of said side and front walls and which project upwardly beyond the upper level of said back wall so as to bear frictionally against the inside of said side and front portions of the lid when closed and extend downwardly interiorally of said body to a position between said base and said upper level of said back wall; the side panel of the inner frame and the adjacent side wall of the body at each side of the packet having abutting edges which face downwardly and upwardly respectively to limit movement of the inner frame towards the base; the upwardly facing abutting edge of each side wall being formed by a substantially rectangular cut-out extending downwardly from the top of each inner layer of said side wall and the downwardly facing abutting edge of each side panel being formed by a projection which protrudes from the plane of the panel into the plane of the adjacent wall.

14. A hinged lid packet comprising a body having a back wall, a front wall, a pair of side walls, each having inner and outer layers of material, and a base; a lid having front and side portions, and a rear portion hinged to said back wall; and an inner frame having a pair of side panels and a front panel which are mounted respectively against the inside of said side and front walls and which project upwardly beyond the upper level of said back wall so as to bear frictionally against the inside of said side and front portions of the lid when closed and extend downwardly interiorally of said body to a position between said base and said upper level of said back wall; at least one of said panels of the inner frame having at least one first abutting edge and a wall of the body adjacent said first abutting edge having a further abutting edge engaging said first abutting edge, said abutting edges facing downwardly and upwardly respectively to limit movement of the inner frame towards the base; each side of said inner frame being provided with a projection having said downwardly facing abutting edge and being formed by an outwardly bent corner at the lower edge of each side panel, said corner being defined by a vertical cut made in said lower edge, said projection protruding into the plane of said respective side wall, and each inner layer of said side walls being provided with a substantially rectangular cut-out towards the top thereof forming said upwardly facing abutting edge.

15. A hinged lid packet as claimed in claim 14 in which said cut-out in the inner layer of each side wall is in the shape of a slot defined by front and rear vertical edges and by said upwardly facing abutting edge, said vertical cut in each side panel of the inner frame corresponding with the rear vertical edge of the slot in the adjacent side wall.

16. A hinged lid packet comprising a body having a back wall, a front wall, a pair of side walls and a base; a lid having front and side portions, and a rear portion hinged to said back wall; and an inner frame having a pair of side walls and a front wall which are mounted respectively against the inside of said side and front walls of said body, providing pair of adjacent front and side walls, and which project upwardly beyond the upper level of said back wall so as to bear frictionally against the inside of said side and front portions of the lid when closed and extend downwardly interiorrally of said body to a position intermediate said base and said upper level of said back wall; at least one pair of abutting edges located at at least one of said pairs of adjacent walls, one of said abutting edges of each pair being located at a wall of said inner frame and the other of said abutting edges being located at an adjacent wall of said body, the abutting edges of each pair facing upwardly and downwardly respectively to limit movement of said inner frame towards said base, the abutting edge of at least one of said walls of said inner frame being provided by a projection which protrudes from the plane of said wall into the plane of the adjacent wall of said body, said at least one wall of said inner frame including a vertical cut extending to the lower edge of said wall, said projection being formed by an outwardly bent corner at the lower edge of said side wall of said inner frame, said corner being defined by the intersection of said vertical cut and said lower edge.

17. A hinged lid packet as claimed in claim 16 wherein the wall of said body adjacent said wall of said inner frame including said projection includes a cut-out in the shape of a slot defined by front and rear vertical edges and by said upwardly facing abutting edge, said vertical cut in said wall of said inner frame corresponding with the rear vertical edge of said slot in said adjacent side wall of said body.

* * * * *